United States Patent [19]

Dziubakowski

[11] Patent Number: 4,776,301

[45] Date of Patent: Oct. 11, 1988

[54] ADVANCED STEAM TEMPERATURE CONTROL

[75] Inventor: Donald J. Dziubakowski, Seven Hills, Ohio

[73] Assignee: The Babcock & Wilcox Company, New Orleans, La.

[21] Appl. No.: 25,047

[22] Filed: Mar. 12, 1987

[51] Int. Cl.[4] ..... F22G 5/00

[52] U.S. Cl. ..... 122/479 R; 165/13

[58] Field of Search ..... 122/479 R, 479 S, 406 ST, 122/448 R, 448 S; 165/13; 236/14

[56] References Cited

U.S. PATENT DOCUMENTS

| | | | |
|---|---|---|---|
| 4,241,701 | 12/1980 | Morse | 122/479 R X |
| 4,296,730 | 10/1981 | Zadiraka | 122/479 R |
| 4,549,503 | 10/1985 | Keyes, III et al. | 122/479 R |
| 4,637,348 | 1/1987 | Fukayama | 122/406 ST |

*Primary Examiner*—Edward G. Favors

*Attorney, Agent, or Firm*—Vytas R. Matas; Robert J. Edwards

[57] ABSTRACT

A control system for a heat exchanger, such as a superheater in a fossil fuel fired steam generator, uses a multivariable non-linear regression equation to develop a feed forward signal that continuously adapts itself to changes in system variables to adjust the enthalpy of the steam entering the superheater and maintain a substantially constant enthalpy of the steam discharged from the superheater. The system develops a feedback signal responsive to changes in the temperature of the steam discharged from the superheater to readjust the enthalpy of the steam entering the superheater as required to maintain the steam leaving the superheater at a predetermined set point temperature.

11 Claims, 2 Drawing Sheets

ADVANCED STEAM TEMPERATURE CONTROL

BACKGROUND OF THE INVENTION

1. Field of the Invention

This invention relates to the control of the heat absorption in a heat exchanger to maintain the temperature of the fluid discharged from the heat exchanger at a set point value. More particularly this invention relates to the control of the temperature of the steam leaving the secondary superheater or reheater of large size fossil fuel fired drum or separator type steam generators supplying steam to a turbine having a high and a low pressure unit. As an order of magnitude such steam generators may be rated at upwards of 6,000,000 pounds of steam per hour at 2,500 psi and 1,000 degrees Fahrenheit. The generic term "superheater" as used hereafter will be understood to include a secondary superheater, a reheater or primary superheater as the control system of this invention is applicable to the control of each of these types of heat exchangers.

The steam-water and air-gas cycles for such steam generators are well known in the art and are illustrated and described in the book "Steam Its Generation and Use" published by The Babcock & Wilcox Company, Library of Congress Catalog Card No. 75-7696. Typically in such steam generators, the saturated steam leaving the drum or separator passes through a convection primary superheater, a convection or radiant secondary superheater, then through the high pressure turbine unit, convection or radiant reheater to the low pressure turbine unit. The flue gas leaving the furnace passes in reverse order through the secondary superheater, reheater and the primary superheater. To prevent physical damage to the steam generator and turbine and to maintain maximum cycle efficiency it is essential that the steam leaving the secondary superheater and reheater be maintained at set point values.

It is well known in the art that the heat absorption in a heat exchanger such as a superheater or reheater is a function of the mass gas flow across the heat transfer surface and the gas temperature. Accordingly, if uncontrolled, the temperature of the steam leaving a convection superheater or reheater will increase with steam generation load and excess air, whereas the temperature of the steam leaving a radiant superheater or reheater will decrease with steam generator load.

The functional relationship between boiler load and uncontrolled final steam temperature at standard or design conditions is usually available from historical data, or it may be calculated from test data. From such functional relationship there may be calculated the relationship between boiler load and flow of a convective agent, such as flow of water to a spray attemperator, required to maintain the temperature of the steam discharged from the superheater at set point value. Seldom, if ever, does a steam generator operate at standard or design conditions so that while the general characteristic between steam generator load and temperature of the steam discharged from the superheater may remain constant, the heat absorption in a superheater or reheater and hence the temperature of the steam discharged from a superheater, will, at constant load, change in accordance with system variables, such as, but not limited to, changes in excess air, feed water temperature and heat transfer surface cleanliness.

Control systems presently in use, as illustrated and described in The Babcock & Wilcox Company's publication, are of the one or two element tpe. In the one element type a feed back signal responsive to the temperature of the steam discharged from the superheater adjusts a convective agent, such as water or steam flow to a spray attemperator. In the two element type a feed forward signal responsive to changes in steam flow or air flow adjusts the convective agent which is then readjusted from the temperature of the steam discharged from the superheter. It is evident that neither of these control systems can correct for changes in the heat absorption of the superheater caused by changes in system variables.

SUMMARY OF THE INVENTION

In accordance with this invention the thermodynamic properties are used to arrive at the calculated value of a corrective agent which may be, for example, water or steam flow to a spray attemperator, excess air, gas recirculation, or the tilt of movable burners, required to maintain the enthalpy of the steam discharged from a superheater at set point value.

Further, in accordance with this invention a feed forward signal is derived which includes a computed value for the heat absorption in the superheater required to maintain the enthalpy of the steam discharged from the superheater at set point value.

Further in accordance with this invention the computed value for the heat absorption in the superheater is updated on a regular basis to account for changes in system variables such as, for example, changes in excess air, feed water temperature, fuel composition and heating surface cleanliness.

Further in accordance with this invention the computed value of the heat absorption in the superheater is updated under steady state conditions, at selected points along the load range.

These and other objects of the invention will be apparent as the description proceeds in connection with the drawings in which:

DETAILED DESCRIPTION

The embodiment of the invention now to be described is a two element system for maintaining the temperature of the steam discharged from a superheater, heated by convection from the flue gas flowing over the heat transfer surfaces. In the control system a feed forward signal is developed which adjusts the heat absorption in the superheater in anticipation of the change required by changes in system variables, such as, a change in load, a change in excess air, or a change in feedwater temperature.

Figure 1:
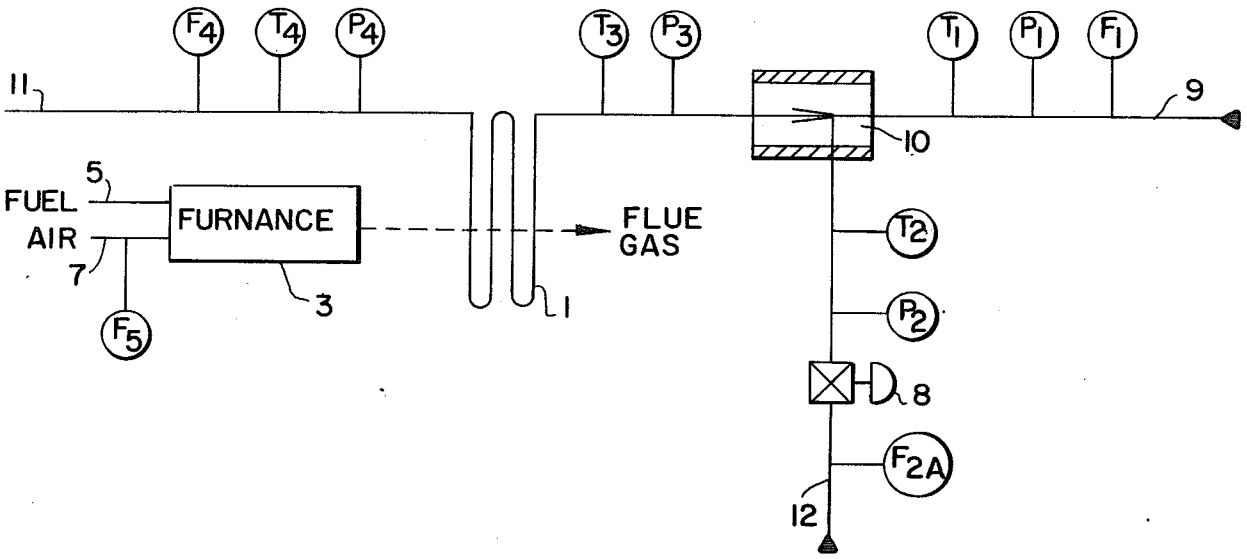
FIG. 1 is a fragmentary, diagrammatic view of a steam generator and superheater.

In FIG. 1, there is shown a superheater, heated by the flue gas discharged from a furnace to which fuel and air are supplied through conduits 5 and 7 respectively. Steam from any suitable source, such as a primary superheater (not shown) is admitted into the superheater 1 through a conduit 9 and discharged therefrom through a conduit 11. A valve 8 in conduit 12 regulates the flow of a coolant, such as water or steam, to a spray attemperator 10 for adjusting the heat absorption in the superheater. Shown in FIG. 1 are the physical measurements required to practice this invention and which are identified by a descriptive letter and a subscript denoting its location. Transducers for translating such measurements into analog or digital signals are well known in the art and will not, in the interest of brevity, be shown or disclosed.

The set point, i.e., the rate of flow of coolant to the superheater required to maintain the enthalpy of the steam discharged from the superheater at a predetermined value, regardless of changes in system variables is delivered as follows:

$$H_1 + H_2 + \Delta H = H_4 \quad (1)$$

$$F_1h_1 + F_2h_2 + \Delta H = h_4(F_1 + F_2) \quad (2)$$

$$F_{2c} = F_1\frac{(h_1 - h_4)}{(h_4 - h_2)} + \frac{\Delta H_c}{(h_4 - h_2)} \quad (3)$$

where:

$F_{2c}$=computed feed forward coolant flow set point

H=BTU/hr. heat flow h=enthalpy h=f(T,P)

$\Delta H_c$=computed value of heat absorption in superheater

The functional relationship between enthalpy, pressure and temperature, $h=f(T,P)$, is determined from steam tables stored in a computer 15, or from the techniques illustrated and discussed in U.S. Pat. No. 4,244,216 entitled "Heat Flowmeter".

In accorance with this invention $\Delta H_c$ is computed using historical data, updated on a regular basis using a multivariable regression calculation. Significantly, this computation uses a uniform distribution of load points over the entire load range. This uniform distribution permits the maintaining of load related data from other than common operating loads. Thus $\Delta H_c$ will, under all operating conditions, closely approximate that required to maintain the enthalpy of the steam discharged from the superheater at set point value.

Figure 2:
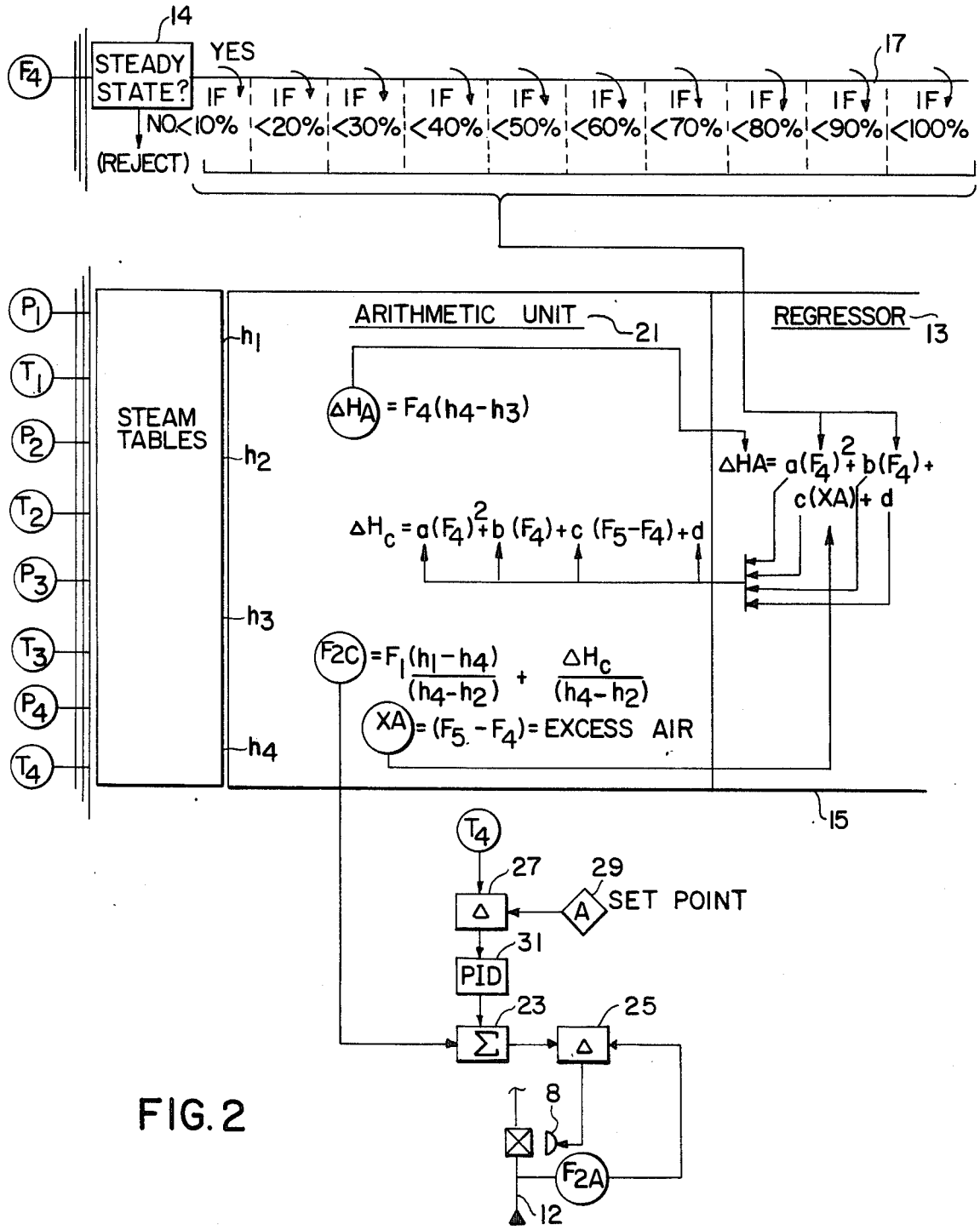
FIG. 2 is a logic diagram of a control system, incorporating the principles of this invention.

As shown in FIG. 2, a signal proportional to $F_4$ is introduced into a logic unit 14, which if within preselected steady state conditions, is allowed to pass to a load point finder unit 17 and then to regressor 13 within computer 15. For purposes of illustration, load point finder unit 17 is shown as dividing the load range into ten segments. Fewer or more segments can be used depending on system requirements.

The independent variables selected for this application are steam flow and excess air flow or flue gas flow. Based on historical data it is known that the heat absorption in a convection superheater, if uncontrolled, varies as $(F_4)^2$ and linear with the rate of flow of excess air ($X_A$), or rate of flow of flue gas and can be expressed as:

$$\Delta H_A = a\,(F_4)^2 + b\,(F_4) + c(X_A) + d \quad (4)$$

where:

$$X_A = (F_5 - F_4)$$

a, b, c and d are coefficients computed in regressor 13 based on least square fit.

$$\Delta H_A = F_4\,(h_4 - h_3) \quad (5)$$

From equation (4) it is evident that the fundamental relationship between heat absorption, steam flow and excess air flow remains constant regardless of changes in system variables, but that the constants a, b, c, will vary in accordance with changes in system variables. Under steady state coditions, these constants are recomputed so that $\Delta H_c$ will be that required to maintain the enthalpy, and accordingly, the temperature of the steam exiting the superheater 1 at predetermined set point values within close limits.

Once the coefficients are determined the heat absorption $\Delta H_c$ can be computed as shown in arithmetical unit 21 housed in computer 15. Knowing $\Delta H_c$ a feed forward coolant flow control signal $F_{2c}$, computed in the arithmetical unit 21 is transmitted to a summing unit 23, the output signal of which in introduced into a difference unit 25 where it functions as the set point of a local feedback control adjusting the valve 8 to maintain $F_{2A}$ equal to $F_{2c}$.

The control system includes a conventional feedback control loop which modifies the calculated $F_{2c}$ signal as required to maintain $T_4$ at set point. A signal proportional to $T_4$ is inputted to a difference unit 27, which outputs a signal proportional to the difference between the $T_4$ signal and a set point signal generated in adjustable signal generator 29 proportional to the $T_4$ set point. The output signal from difference unit 27 is inputted to a PID (proportional, integral, derivative) control unit 31 which generates a signal varying as required to maintain $T_4$ at set point. The output signal from unit 31 is inputted to summing unit 23, and serves to modify the feed forward signal $F_{2c}$.

The control system shown is by way of example only. The control principle embodied in the example can be applied to other types of heat exchangers, to other types of superheaters and to other forms of corrective means such as tilting burners, excess air and gas recirculation. It will further be apparent to those familiar with the art that a signal $T_{3c}$ can be developed, in place of signal $F_{2c}$, adjusting the flow of coolant to attemperator 10 as required to maintain the enthalpy of the steam leaving the superheater 1 at substantially set point value. Although the preferred embodiment is described for a large size fossil fuel fired drum or separator type steam generator, the principle described herein can be equally applied to other steam generator types including nuclear fueled units and smaller heat exchangers.

I claim:

1. A control system for a heat exchanger wherein heat is exchanged between two heat carriers, comprising:

a regressor, for updating the values of coefficients in a multivariable non-linear regression equation due to changes in system variables and for providing signals indicative of said updated coefficients;

means for generating a feed forward coolant flow set point signal $F_{2c}$ based upon said updated coefficients, corresponding to a calculated value $\Delta H_c$ of the heat absorbed in one of the heat carriers from the other required to maintain the enthalpy of one of the heat carriers leaving the heat exchanger at a predetermined value; and means under the control of said feed forward coolant flow set point signal $F_{2c}$ for adjusting the heat absorption in said one of said heat carriers.

2. A control system as set forth in claim 1, further including:

means for generating a feedback control signal corresponding to the difference between the temperature of one of said heat carriers leaving the heat exchanger and a predetermined set point temperature; and means under the control of said feedback control signal for modifying said feed forward coolant flow set point signal $F_{2c}$ as required to maintain the temperature of said one heat carrier leaving the heat exchanger at said predetermined set point temperature.

3. A control system as set forth in claim 1, wherein said heat exchanger is a convection superheater heated by the flue gas from a fossil fuel fired steam generator and the means under the control of said feed forward coolant flow set point signal $F_{2c}$ is a means for adjusting the rate of flow of a coolant modifying the enthalpy of the steam entering said superheater.

4. A control system as set forth in claim 1, wherein said heat exchanger is a convection superheater heated by the flue gas from a fossil fuel fired steam generator and the means under the control of said feed forward coolant flow set point signal $F_{2c}$ is a means for adjusting the rate of flow of water discharged into the steam entering the superheater for modifying the enthalpy of the steam and the rate of flow of the steam entering the superheater.

5. A control system as set forth in claim 1, wherein said means for generating a feed forward coolant flow set point signal $F_{2c}$ receives said signals indicative of said updated coefficients and is responsive to the rate of flow of one of said heat carriers through said heat exchanger, for generating an output signal varying in non-linear relationship to said rate of flow.

6. A control system as set forth in claim 5, further including means, under steady state conditions, for updating said multivariable non-linear regression equation in accordance with a change in the rate of heat transfer between the two heat carriers.

7. A control system as set forth in claim 1, wherein said heat exchanger is a convection superheater heated by the flue gas from a steam generator supplied with fuel and air for combustion, and where said means for generating a feed forward coolant flow set point signal $F_{2c}$ receives said signals indicative of said updated coefficients and is responsive to the rate of flow of steam and flue gas through said superheater.

8. A control system as set forth in claim 7, wherein said rate of flow of flue gas through said superheater is determined by means responsive to the difference between the rate of flow of air supplied for combustion and the rate of steam generation.

9. A control system for a superheater heated by the flue gas from a fossil fuel fired steam generator, comprising:

means for determining if said steam generator is within preselected steady state conditions;

a regressor, connected to said steady state condition determining means, for updating the values of coefficients in a multivariable non-linear regression equation due to changes in system variables and for providing signals indicative of said updated coefficients;

means for generating a feed forward coolant flow set point signal $F_{2c}$ based upon said updated coefficients, corresponding to a calculated value $\Delta H_c$ of the heat absorbed by the steam from the flue gas required to maintain the enthalpy of the steam at a predetermined value;

means for generating a feedback control signal corresponding to the difference between the temperature of the steam leaving the superheater and a predetermined set point temperature; and means, under the control of said feedback control signal, for modifying said feed forward coolant flow set point signal $F_{2c}$ as required to maintain the temperature of the steam at said predetermined set point temperature.

10. A control system as set forth in claim 9, wherein said system variables comprise a rate of steam flow through said superheater and an amount of excess air supplied to said steam generator for combustion with said fossil fuel.

11. A control system as set forth in claim 10, further including a load point finder, connected between said steady state condition determining means and said regressor, for providing a uniform distribution of load point data to said regressor from other than common operating loads of the steam generator.

* * * * *